United States Patent [19]

Pongrass et al.

[11] Patent Number: 4,524,458

[45] Date of Patent: Jun. 18, 1985

[54] MOISTURE RESPONSIVE STIFFENING MEMBERS FOR FLEXIBLE CONTAINERS

[76] Inventors: Robert G. Pongrass, 122 Ocean St., Woollahra 2025, New South Wales, Australia; Christopher C. Rutter, 21063 Cabot Blvd., Hayward, Calif. 94545

[21] Appl. No.: 555,045

[22] Filed: Nov. 25, 1983

[51] Int. Cl.[3] ..... B65D 19/20

[52] U.S. Cl. ..... 383/33; 383/37; 383/46; 222/105; 222/183; 220/86 R

[58] Field of Search ..... 222/105, 107, 183, 211, 222/464; 383/33, 36, 37, 46; 220/86 R

[56] References Cited

U.S. PATENT DOCUMENTS

| | | | |
|---|---|---|---|
| 3,112,047 | 11/1963 | Weinreich et al. | 383/36 |
| 3,254,828 | 6/1966 | Lerner | 383/37 |
| 3,366,284 | 1/1968 | Marona et al. | 222/211 |
| 3,469,769 | 9/1969 | Guenther | 383/37 |
| 3,471,064 | 10/1969 | Micallef | 222/211 |
| 4,193,518 | 3/1980 | Holmes | 222/105 |
| 4,258,863 | 3/1981 | Ness | 222/183 |
| 4,375,864 | 3/1983 | Savage | 222/105 |
| 4,381,846 | 5/1983 | Heck | 222/183 |

*Primary Examiner*—George E. Lowrance
*Assistant Examiner*—David T. Fidei
*Attorney, Agent, or Firm*—Linval B. Castle

[57] ABSTRACT

Flexible plastic bags used for the bulk storage and dispensing of fluids are often blocked from dispensing all the contents and/or entrap part of the contents in folds of the plastic as they shrink during dispensing. The invention is for a tongue or dip tube that is attached to the inner wall of the plastic bag near the location of the dispensing aperture. The tongue is formed of a laminate of two dissimilar materials, one non-hygroscopic and the other being hygroscopic, so that upon introduction of moisture into the bag, the hygroscopic layer will expand and the normally flat tongue will curl to form a thick tube that both prevents collapse of the bag and prevents closure of the dispensing aperture by the opposite wall of the bag.

10 Claims, 14 Drawing Figures

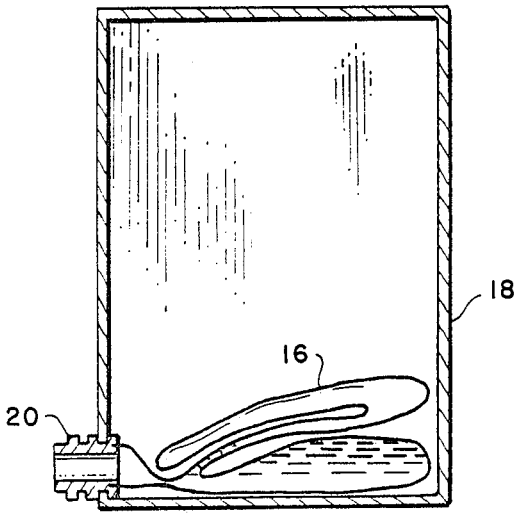
FIG. 1 - PRIOR ART
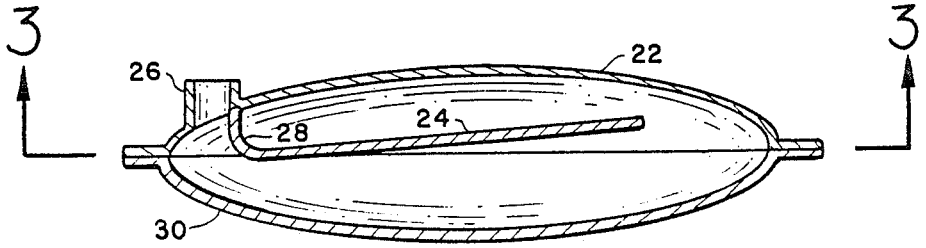
FIG. 2 -
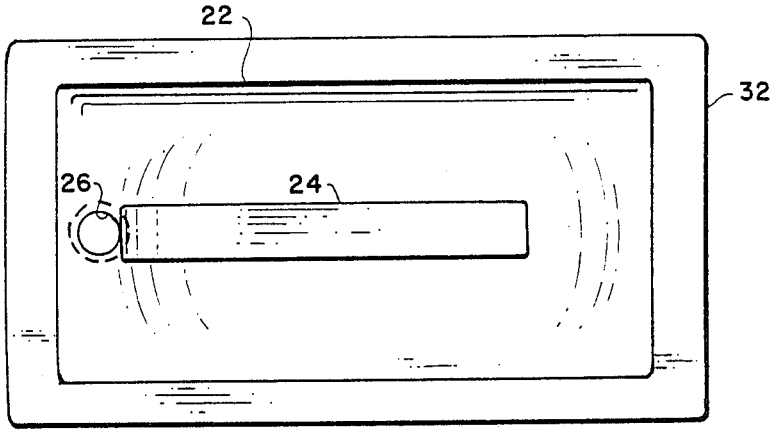
FIG. 3 -

FIG-9-
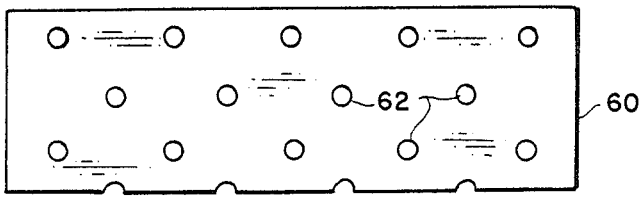
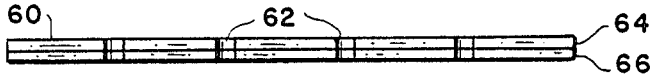
FIG-10-
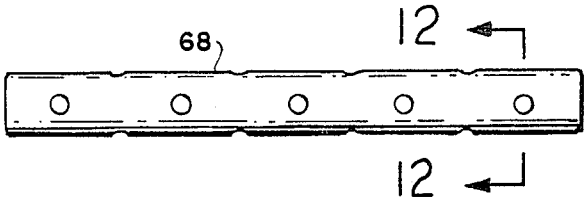
FIG-11-
FIG-13-
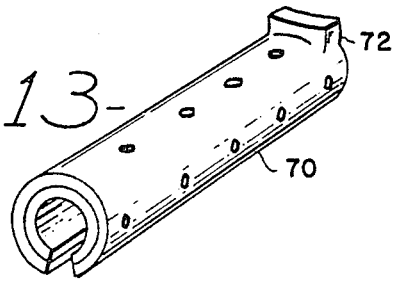
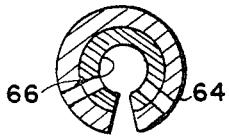
FIG-12-
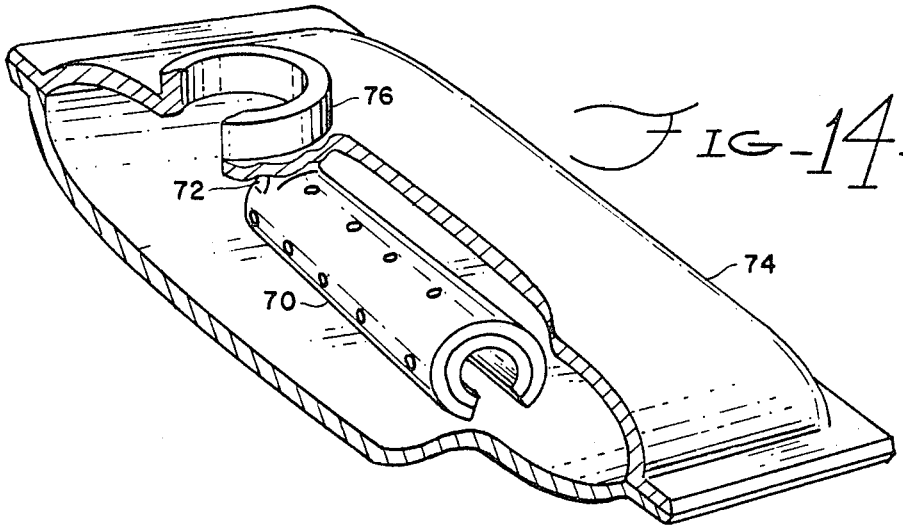
FIG-14-

MOISTURE RESPONSIVE STIFFENING MEMBERS FOR FLEXIBLE CONTAINERS

BRIEF SUMMARY OF THE INVENTION

This invention relates generally to flexible bag packaging and in particular to a novel means for preventing accidental sealing of a bag aperture by the opposite surface of the bag.

Flexible, sealable, laminated plastic bags are rapidly gaining popularity for packaging of various products that may be deleteriously affected by exposure to the atmosphere or to other comtaminating environments. Comestibles, and particularly liquids such as wines are often packaged in sealed bags that are housed in rigid boxes for convenient shipping, storing and eventual purchase by the consumer who then pierces the seal and attaches a tap for dispensing of the fluid. One important advantage of such a bag-in-box dispensing system is that the bag shrinks in volume as the fluid level is lowered and thus no oxidizing atmosphere is able to reach the contents.

One problem encountered with the flexible bag dispensers is that the dispensing aperture in one surface of the bag often becomes covered with the opposite surface, or forms sealed pockets, as the bag shrinks in volume. Thus, for example, a one gallon capacity flexible bag may entrap a pint or more of the product in the folds of the collapsing bag; this pint can only be removed by cutting open the bag.

There are two principle designs for flexible laminated plastic bags used in the packaging industry. In one design, the bag is filled through an entrance aperture that is then sealed, usually by heat sealing against the opposite surface of the plastic bag. Thus in this design, there is no dispensing aperture and the contents are eventually dispensed by a piercing tap such as disclosed in U.S. Pat. No. 4,322,018 of Mar. 30, 1982. In the second design, the plastic bag is provided with an aperture to which is attached a fitment or spout acceptable to most automatic filling machinery. The bag is thus filled through the aperture which is then sealed until opened by the consumer's dispensing device. Both of the described bag designs are available as a continuous interconnected web of bags for use with the above mentioned automatic filling machinery as described in U.S. Pat. No. 4,386,636 of June 7, 1983.

To prevent the faces of a flexible bag from sealing off the dispensing aperture and/or for capturing a pocket of the contents, some manufacturers have attached a so-called "dip tube" to the fitment or spout that is attached to the aperture. The dip tube extends into the flexible bag to prevent the bag from closing on itself, thus providing a path for the entrapped contents to reach the aperture through which they are expelled. It is to be noted that the dip tube is attached to the spout and is not available for the sealed flexible bag without dispensing aperature as discussed above as the first design.

BRIEF DESCRIPTION

The present invention is for a dip tube, or tongue, that is attached during manufacture of the flexible plastic bag to the inner wall and adjacent the position of the dispensing aperture. In bags that are fully sealed and without preformed dispensing apertures, the tongue is attached to the bag inner wall near the point of a bag piercing or dispensing tap. In the preferred embodiment, the tongue attached to the inner wall is made of a laminate of two dissimilar materials, one being hygroscopic, the other non-hygroscopic, so that upon the introduction of moisture into the bag, the dissimilar materials in the tongue will cause the tongue to curl into a tubular pattern. This dip tube will further separate the inner walls of the container to prevent their closure and thus permit free flow through the dispensing aperture.

DESCRIPTION OF THE DRAWINGS

In the drawings that illustrate the preferred embodiment of the invention:

FIG. 1 is a sectional elevation view of a typical prior art plastic bag in a rigid container and illustrates the entrapment of fluid in the folds of a shrinking bag;

FIG. 2 is a sectional side view of a plastic container bag with an internal tongue attached near the container dispensing aperture;

FIG. 3 is a sectional view taken along the lines 3—3 of FIG. 2;

FIG. 9 is a plan view illustrating another form of a dissimilar laminate for forming a dip tube;

FIG. 10 is a sectional side view of the laminate of FIG. 9;

FIG. 11 illustrates the laminate of FIGS. 9 and 10 formed into a dip tube by the exposure to moisture;

FIG. 12 is a sectional cross sectional view taken along the lines 12—12 of FIG. 11;

FIG. 13 is a perspective view of the dip tube of FIGS. 11 and 12; and FIG. 14 is a perspective sectional view of the dip tube of FIGS. 11–13 as a part of a flexible plastic container bag.

DETAILED DESCRIPTION OF THE PREFERRED EMBODIMENT

Figure 6:
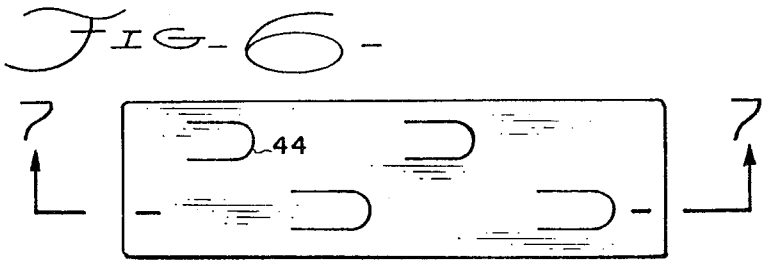
FIG. 6 is a plan view of a laminate of two dissimilar tongues and illustrates U-shaped cuts through the surface.

FIG. 1 is a cross section view illustrating a typical flexible plastic bag 16 within a rigid box 18 which supports a fitment 20 attached to the dispensing aperture of the bag 16. The bag in box container is generally used for the bulk storage and dispensing of a fluid that may be affected by exposure to the atmosphere but the bag 16 may be used for the storage and dispensing of any free-flowing dry material. Normally, the fitment 20 is used to fill the flexible bag 16 and also to dispense the contents therefrom after removal of a seal applied to the fitment 20 after filling.

When filled, the bag 16 is normally expanded into the entire volume of the rigid box 18 and may contain several gallons of a liquid or dry material. As the contents of the bag 16 is dispensed through an appropriate valve or tap connected to the apertured fitment 20 the bag 16 shrinks without admitting any exterior air that may contaminate the remainder of its contents. However, as the bag collapses its surfaces very often close against the interior surface of the aperture of fitment 20 to seal the remaining fluid in the container or captures quantities of the liquid within folds formed in the bag 16 during its collapse, as illustrated in FIG. 1. In such systems, this captured fluid can only be recovered by opening the rigid box 18 and the flexible plastic box 16 therein.

FIG. 2 is a sectional view illustrating a flexible plastic bag 22 which, during manufacture, is provided with a relatively stiff plastic tongue 24 that is attached to the inner wall of the bag adjacent a bag aperture 26 which will be welded to the box fitment such as the fitment 20 in FIG. 1. In use, the flexible bag of FIG. 2 is filled through the aperture 26, sealed and inserted into a rigid box such as the box 18 of FIG. 1. When the fluid within the bag is eventually dispensed, the seal is broken and the flexible bag 22 collapses as the fluid is drained therefrom. However, the relatively stiff tongue 24 which extends through at least half of the length of the bag and which is formed with an L-shaped segment 28 adjacent the aperture 26, will both prevent folds from occurring within the bag and prevent the rear surface 30 from closing over the aperture 26. Thus, all fluid will be drained from the bag without the danger of entraping portions in plastic folds or behind a closed aperture.

FIG. 3 is a sectional view taken along the lines 3—3 of FIG. 2 and illustrates the tongue 24 to be a relatively narrow but long member suitably positioned with respect to the aperture 26 to prevent accidental closure of the bag 22. It will be noticed from an inspection of FIGS. 2 and 3 that the flexible bag 22 is preferably formed from two sheets of plastic that are welded together around the periphery 32 to form the bag. Prior to the joining of the two sides, the tongue 24 is welded to or otherwise formed on the one bag surface at a position adjacent a filling and dispensing aperature.

Figure 4:
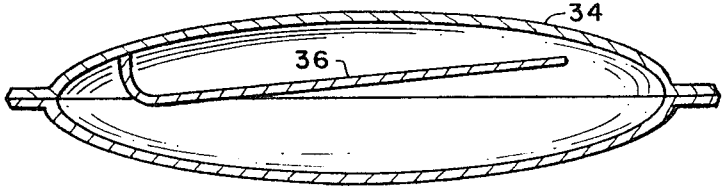
FIG. 4 is a sectional view of an internal tongue attached to the inner walls of a sealed, flexible plastic bag without a dispensing aperture.

FIG. 4 is a cross sectional illustration of a bag similar to that illustrated in FIG. 2 but without the filling and dispensing aperture. Bags such as that illustrated in FIG. 4 are of the type that are opened by a piercing dispenser tap which pierces the surface of the filled and sealed plastic bag to dispense the contents therefrom. To fill a bag such as that illustrated in FIG. 4, a small aperture is cut through one surface of the bag, the bag is filled and the aperture is then sealed, usually by heat welding the surface containing the filling aperture against the opposite surface of the bag. In FIG. 4, the bag 4 is provided with an L-shaped tongue 36 the short section of which is attached to one surface of the bag near the point where a piercing dispensing tap would enter the bag. It will be noted from an inspection of FIG. 4 that the elongated tongue 36 will prevent collapse of the bag or sealing of the dispensing tap if the tap pierces either wall of the bag at a point near the attachment of the tongue.

Figure 5:
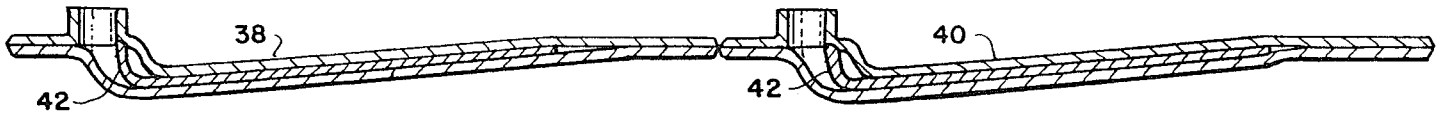
FIG. 5 is a sectional view of a section of an interconnected web of bags used with automatic filling machinery and illustrates the attachment of the internal tongues.

As previously mentioned, flexible plastic bags are used with conventional automatic filling equipment are fed toward the filling station as a web of interconnected bags. FIG. 5 is sectional side view of two such interconnected bags 38 and 40 similar to that disclosed in FIG. 2. Each bag contains an L-shaped tongue 42 which will prevent the entrapment of portions of the contents of the bag as the bag collapses during the dispensing of the contents.

Figure 7:
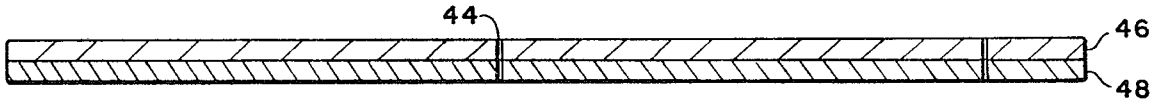
FIG. 7 is a sectional view taken along the lines 7—7 of FIG. 6.
Figure 8:
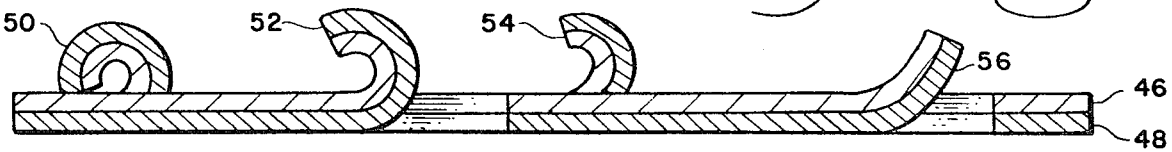
FIG. 8 is a sectional view of the tongue of FIG. 7 illustrating typical formation of dip tubes from U-shaped segments in a tongue upon the introduction of moisture.

The tongue 42 in each of the bags 38, 40 of FIG. 5 may be a semi rigid element as shown and described in connection with FIGS. 2 and 3, or is preferably formed of a laminate of two dissimilar materials as shown in FIGS. 6, 7 and 8. FIG. 6 is a plan view illustrating a portion of a laminate of two dissimilar materials and illustrates a plurality of U-shaped cuts 44 which penetrate through both of the layers forming the laminate as will be subsequently explained. FIG. 7 is a cross sectional view taken along the line 7—7 of FIG. 6 and illustrates a top laminate 46 of a non-hygroscopic, or low moisture absorption material such as polyethylene attached to and overlying a hygroscopic or high moisture absorption material 48 such as, for example, nylon.

FIG. 8 is a sectional view of the material of FIG. 7 reacting to the introduction of a moisture to the material and in particularly in the areas of the U-shaped perforations. Moisture being absorbed by the hygroscopic layer 48 causes the material in that layer to expand whereas the low moisture absorption material in the layer 46 is unaffected. Because the layers 46 and 48 are laminated together, the portions in the U-shaped sections 44 will curl as indicated in FIG. 8. It is true that the entire length of the laminated material will also curl slightly, however the portions entering the material at the U-shaped sections 48 will rapidly curl to provide a thickened series of individual dip tubes that will further separate the inner surfaces of a flexible plastic bag. In FIG. 8, the dip tube 50 will curl as indicated in the drawing upon a relatively long exposure to moisture within the flexible bag. The curl 52 will bend as illustrated upon shorter exposure to moisture and the curl 56 starts to bend as illustrated within a relatively short period after its first exposure to moisture in the flexible bag.

FIG. 9 illustrates another embodiment of a flat tongue 60 containing a plurality of relatively equally spaced apertures 62 that penetrates both upper layer 64 and bottom layer 66 of the laminated material as best illustrated in the edge view of FIG. 10. In the embodiment illustrated, the bottom layer 66 is preferably formed of a low absorption material whereas the laminated upper layer 64 is a high absorption material. It will be noted that the round holes 62 through the laminate do not have the elongated parallel U-shaped cuts 44 of FIG. 6. Therefore, the flat hygroscopic/non hygroscopic laminate of FIGS. 9 and 10 will bend into a tubular configuration when subjected to moisture, as illustrated in FIGS. 11, 12 and 13. FIG. 11 illustrates a tubular shaped dip tube 68 which was formed from the flat laminate 60 of FIG. 9. FIG. 12 is a cross sectional view taken along the lines 12—12 of FIG. 11 and illustrates the tube formed by the expansion of the high moisture absorption material 64 laminated to the non-hygroscopic layer 66 which now forms the core of the dip tube.

FIG. 13 is a perspective view illustrating a dip tube 70 which is identical to the dip tube 68 of FIGS. 11 and 12 but which illustrates the end portion 72 which is heat welded or otherwise connected to the inner surface of a flexible plastic bag such as that illustrated in FIG. 14. FIG. 14 is a sectional view of a flexible plastic bag 74 having a filling and dispensing aperture 76. Attached to the inner surface of the bag 74 and adjacent the edge of the aperature 76 is the dip tube 70 which was a flat planer laminate of two dissimilar materials until moisture within the bag 74 penetrated the aperture through the flat laminate to expand the high absorption layer laminate and thereby form a dip tube 70 for preventing closure of the dispensing aperature or the entrapment of fluids within the collapsing flexible bag.

Having thus described our invention what we claim is:

1. In combination with a flexible packaging bag having first and second surfaces interconnected at the peripheries thereof, anticlosure means within said bag for preventing entrapment of portions of the bag contents in folds in said bag and by stoppage of a dispensing aperture in said bag as said flexible bag collapses during dispensing of the contents therefrom, said anticlosure means comprising:

a thin elongated stiffening member having one end attached to an inner surface of the flexible bag and near the position of a dispensing aperture in said bag, the long axis of said stiffening member being substantially parallel with the longer axis of said bag, said stiffening member being flexible when dry and becoming stiffened by exposure to moisture.

2. The anticlosure means claimed in claim 1 wherein said stiffening member is generally L-shaped, the end of the shorter leg of said member being attached to the inner surface of said bag, the longer leg extending through said bag to prevent collapse of said bag during the dispensing of the contents therefrom.

3. The anticlosure means claimed in claim 1 wherein said flexible packaging bag is one of a plurality of identical bags interconnected at the ends thereof in a continuous strip of bags.

4. The anticlosure means claimed in claim 1 wherein said elongated stiffening member is formed from a bonded laminate of first and second layers, said first layer being a hygroscopic material, said second layer being a non-hydroscopic material, said stiffening member curving in toward said non-hygroscopic layer upon exposure to moisture within said flexible bag.

5. The anticlosure means claimed in claim 4 wherein said means has a plurality of U-shaped cuts through said first and said second layers, each of said cuts forming an individual curl toward said non-hygroscopic layer for preventing collapse of the bag during dispensing of the contents therefrom.

6. The anticlosure means claimed in claim 4 wherein said means has a plurality of small apertures through said first and second layers whereby said means forms a tubular shape upon the introduction of moisture into said bag.

7. The anticlosure means claimed in claim 5 wherein said hygroscopic layer is nylon.

8. The anticlosure means claimed in claim 5 wherein said non-hygroscopic layer is polyethylene.

9. The anticlosure means claimed in claim 6 wherein said hygroscopic layer is nylon.

10. The anticlosure means claimed in claim 6 wherein said non-hygroscopic layer is polyethylene.

* * * * *